US006826445B2

(12) United States Patent
DiNapoli et al.

(10) Patent No.: US 6,826,445 B2
(45) Date of Patent: Nov. 30, 2004

(54) METHOD AND APPARATUS FOR INSERTING CHECKS INTO A BANK STATEMENT MAIL PIECE

(75) Inventors: Scott C DiNapoli, Wolcott, CT (US); Jean S Leandre, Spring Valley, NY (US); Richard F Stengl, Wolcott, CT (US)

(73) Assignee: Pitney Bowes Inc., Stamford, CT (US)

( * ) Notice: Subject to any disclaimer, the term of this patent is extended or adjusted under 35 U.S.C. 154(b) by 166 days.

(21) Appl. No.: 10/082,779

(22) Filed: Feb. 25, 2002

(65) Prior Publication Data

US 2003/0163220 A1 Aug. 28, 2003

(51) Int. Cl.[7] ..... G07F 7/00
(52) U.S. Cl. ..... 700/223; 700/224; 700/230
(58) Field of Search ..... 700/223, 224, 700/230

(56) References Cited

U.S. PATENT DOCUMENTS 4,733,359 A * 3/1988 Luperti et al. ..... 364/478
4,817,042 A * 3/1989 Pintsov ..... 364/478
5,641,158 A * 6/1997 Gelb, Jr. et al. ..... 271/225
5,708,261 A * 1/1998 Chen ..... 235/463
5,734,566 A * 3/1998 Stengl ..... 364/138
5,754,434 A * 5/1998 Delfer et al. ..... 364/478.11
6,173,274 B1 * 1/2001 Ryan, Jr. ..... 705/408
6,607,190 B1 * 8/2003 Guiles et al. ..... 271/4.03

* cited by examiner

*Primary Examiner*—Donald P. Walsh
*Assistant Examiner*—Michael E Butler
(74) *Attorney, Agent, or Firm*—Michael J. Cummings; Charles R. Malandra, Jr.; Angelo N. Chaclas

(57) ABSTRACT

An enclosure feeder system (500) and corresponding method for use in combining collations in a sequence of collations with a given number of respective corresponding specific enclosures, the enclosures for each successive collation ordinarily being separator by a divider indicator, the enclosure feeder system (500) including: an enclosure feeder (210) for feeding the enclosures, and a supervisory controller (300) for providing to the enclosure feeder (210) a dynamic over-count number, corresponding to a specific collation, equal to one more than the expected number of enclosures for the collation, with the enclosure feeder (210) implemented so as to continue feeding enclosures for a collation until either encountering a divider indicator or until the number of enclosures actually fed is equal to the expected number of enclosures for the collation.

4 Claims, 5 Drawing Sheets

METHOD AND APPARATUS FOR INSERTING CHECKS INTO A BANK STATEMENT MAIL PIECE

BACKGROUND OF THE INVENTION

1. Technical Field

The invention relates to inserter systems included in mailing machines, for assembling documents into batches or into collations and then for inserting the collations into envelopes. More particularly, the invention is directed to collation feeder systems for such inserter systems, and even more particularly to handling some errors in feeding collations.

2. Description of Related Art

Inserter systems capable of generating up to 18,000 mail pieces per hour are well known in the art and are generally used by organizations that produce a large volume of mailings where the content of each mail piece varies. Often, the inputs to an inserter system are computer-generated and printed documents, with each document containing information intended for a particular addressee. The documents may originate from a stack of cut sheets or from a web of forms. It is the function of the inserter system to accept the documents and produce the individual mailings that correspond to each document. To accomplish this, the typical inserter includes a variety of modules for performing different tasks on the documents passing through the inserter. Typical modules are: various web handling modules (slitters, cutters and bursters) for separating the continuous forms into singular or discrete documents, a sheet feeder module for feeding individual cut sheets, an accumulator module for assembling the sheets and/or form documents into a collation, a folder module for folding the collation into a desired configuration (Z-fold, C-fold, half fold), a conveyor/staging module for transporting and queuing the collation, a plurality of enclosure feeder modules for assembling and adding a packet of enclosures to the collation, an insert station module for inserting the collation into an envelope, and a control system to synchronize the operation of the overall inserter system to assure that the collations are properly assembled. Examples of such inserter systems are the 8 Series™ and 9 Series™ inserter systems available from Pitney Bowes, Inc., Stamford, Conn.

Typically, information for control of such inserter systems is read from a control document by a scanner associated with the most upstream module in the inserter system. The control document is generally an address bearing document and contains information specific to a particular addressee. Additionally, each control document contains control information for instructing the downstream modules on how to assemble a particular mail piece. Once scanned, the control information is transmitted to the control system of the inserter system; the control system monitors the processing of the collation through each module. Generally, the control document includes a barcode type control code or other machine-readable markings defining the number of forms or sheets to be accumulated into the collation, the number of enclosures from each of the enclosure feeder modules to be assembled to the collation, and information for other purposes, such as the selection of appropriate postage.

The enclosures assembled to a collation at an enclosure feeder modules are of two types, either generic or specific. The generic enclosures (advertisements, notices, business return envelopes, etc.) are of a general type that are not specifically directed to any particular addressee. Therefore, generic enclosures serve each addressee equally well. On the other hand, specific enclosures (canceled checks, invoice statements, etc.) contain unique information that is directed to a particular addressee. Providing mail pieces with specific enclosures is commonly referred to in the industry as matched mailing; specific enclosures are only meaningful for the appropriate addressee and thus must be matched to each addressee.

An example of a mail piece containing specific enclosures that can be produced by an inserter system is a monthly checking account statement which includes a summary of all account activity (documents—input from the web or sheet feeder modules) and the canceled checks (specific enclosures—input from the enclosure feeder modules). Accordingly, the account summary and the canceled checks associated with the account must be matched together by the inserter system prior to insertion into the envelope.

Therefore, in matched mail applications, a high degree of synchronization must be incorporated into the inserter system for it to function properly. Continuing with the example from above, the canceled checks must be placed into the enclosure feeders in a known order. In similar fashion, the account summaries must be input into the insert system in a corresponding order. In a typical operation, the control document will contain the name, address and account number of a particular addressee. The control code on the control document will inform the inserter system of the number of subsequent following sheets/forms that are necessary to complete the account summary. In response, the inserter system will collect the control document and subsequent sheets/forms in the accumulator module to form a collation. Once completed, the collation advances to the folder module for folding into a desired configuration. After folding, the collation advances to the conveyor/staging module. At this point, the insert system instructs the enclosure feeder modules to feed and collect a packet of enclosures based on information contained in the control code. For example, the insert system may instruct a first enclosure feeder module to feed five enclosures, and a second enclosure feeder module to feed ten enclosures. Next, the document collation is combined with the packet of enclosures to form a new collation, which is then fed downstream for further processing such as inserting it into an envelope. Therefore, it is understood that without a high degree of synchronization, or if something occurs to disturb the synchronization, problems in producing proper matched mailings can occur.

In the particular case of a matched mailing in which an inserter provides a customer bank statement along with corresponding canceled checks, the statement typically includes a code that is machine-readable and conveys to a controller module of the inserter the number of checks that should be included in the mail piece. A check feeder (enclosure feeder) feeds checks to the mail piece stream; typically, a check feeder feeds checks until an account divider page is encountered. Then the check feeder outputs to the controller the number of checks that were fed, and the controller for the inserter compares the number provided by the check feeder to the number conveyed by the code on the bank statement. If the two numbers are equal, the collation is correct and processing continues normally. If the two numbers are different, however, the controller will stop normal processing and operator intervention will be required.

According to the prior art, to prevent the check feeder from continuing to feed an excessive number of checks beyond the expected number (according to the code on the bank statement), a so-called (static) over-count number is provided as an input to the check feeder; a check-feeder will stop feeding checks if either an account divider page is encountered, or as soon as the number of checks fed exceeds the over-count number. A so-called over-count error can occur if either a divider page is missing or if a divider page is misread (by the check feeder). In either case, the account for which checks are being provided by the check feeder ends up with some checks from the next account in the processing stream (or possibly even later accounts than the very next account if the next account divider page is misread or missing). An operator must then reconcile checks from all affected accounts, or which there are always at least two: the account having the bank statement for which checks are being provided and at least one account subsequent in the processing stream.

It would therefore be advantageous to modify a prior art check feeder (or other, similarly operating insertion module) so as to avoid having to have an operator manually reconcile more than one collation in case of an over-count error, i.e. so as to ensure in case of an over-count error that an operator will only have to reconcile the collation for which the over-count error occurred.

SUMMARY OF THE INVENTION

Accordingly, in a first aspect of the invention, an enclosure feeder system is provided for use with an inserter system that combines collations in a sequence of collations with a given number of respective corresponding specific enclosures, the enclosure feeder system for providing the enclosures to be combined with the collations, the enclosures for each successive collation ordinarily being separator by a divider indicator for indicating the end of the sequence of enclosures for a collation, the enclosure feeder system comprising: enclosure feeding means, responsive to a feed count request for a collation and to an expected number of respective corresponding specific enclosures, for feeding the specific enclosures and for providing an enclosure count corresponding to the number of specific enclosures actually fed; and supervisory control means, responsive to the expected number of respective corresponding specific enclosures, for providing the feed count request for a collation and the expected number of respective corresponding specific enclosures, and further responsive to the enclosure count corresponding to the number of specific enclosures actually fed, for comparing the number of enclosures actually fed for a collation to the expected number of respective corresponding specific enclosures; wherein the enclosure feeding means continues feeding enclosures for the collation until either encountering a divider indicator or until the number of enclosures is equal to the expected number of enclosures.

In accord with the first aspect of the invention, the enclosure feeder system may also comprise an input analyzer for providing for each collation in the sequence of collations the expected number of respective corresponding specific enclosures, and the input analyzer may determine the expected number of respective corresponding specific enclosures based on information provided in a control document included in each collation.

Also in accord with the first aspect of the invention, if the enclosure feeding means discontinues feeding enclosures before encountering and recognizing a divider indicator, then the enclosure feeding means may use as the enclosure count for the collation a number based on the expected number of enclosures, and otherwise may use the number of enclosures actually fed for the collation. Further, the number based on the expected number of enclosures used as the enclosure count may be one more than the expected number of enclosures.

In a second aspect of the invention, a method is provided for monitoring and coordinating the processing of a sequence of collations through an inserter system, the inserter system for combining each collation in the sequence of collations with a given number of respective corresponding specific enclosures, the enclosures for each successive collation ordinarily being separator by a divider indicator for indicating the end of the sequence of enclosures for a collation, the method comprising: determining for each collation in the sequence of collations the expected number of respective corresponding specific enclosures; searching for each collation for an indication of the end of the sequence of enclosures for the collation; and feeding the specific enclosures until either reaching the indication of the end of the sequence of enclosures for the collation or until having fed a number of enclosures equal to the expected number of enclosures.

In accord with the second aspect, the expected number of respective corresponding specific enclosures may be determined based on information provided in a control document included in each collation.

Also in accord with the second aspect, if the feeding of the specific enclosures is discontinued before encountering and recognizing an indication of the end of the sequence of enclosures, then the method may use as the enclosure count for the collation a number based on the expected number of enclosures, and otherwise may use as the enclosure count the number of enclosures actually fed for the collation. Further, the number based on the expected number of enclosures used as the enclosure count may be one more than the expected number of enclosures.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

BEST MODE FOR CARRYING OUT THE INVENTION

The invention is described below in the context of providing a matched mailing of bank statements and corresponding canceled checks. It should be understood, however, that the invention has more general applicability. As is clear from the description that follows, the invention applies to any matched mailing in which, according to the prior art, a static over-count number is used.

An Inserter System in which the Invention can be Practiced

Figure 1:
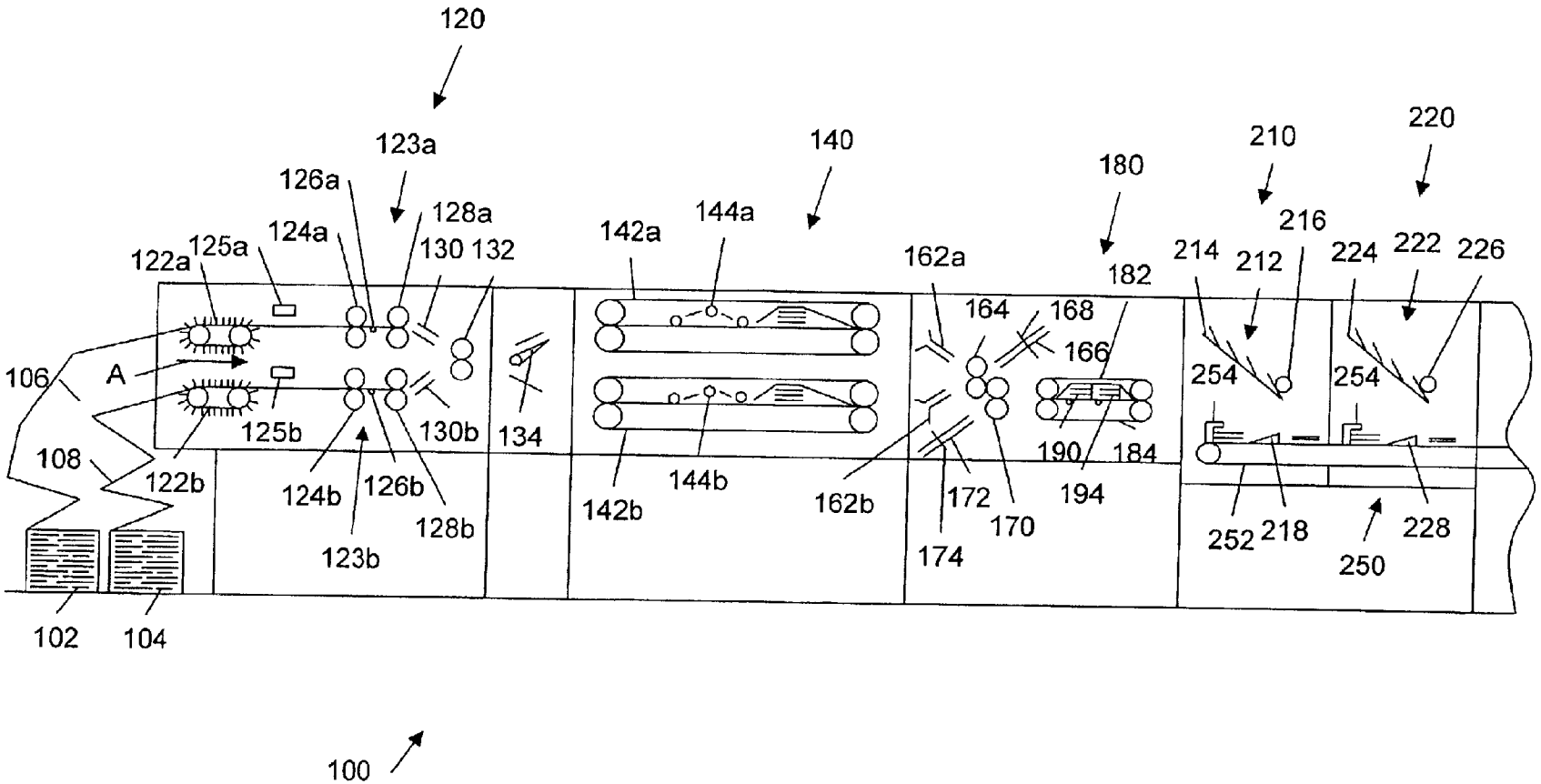
FIG. 1 is a schematic elevational view of an inserter system in which the present invention may be employed.

Referring now to the drawings, and particularly to FIG. 1, there is shown in diagrammatic form a representative inserter system 100 for processing documents fed in a path of travel generally indicated by arrow "A". Typically, inserter systems of the type shown in FIG. 1 include an input section for assembling printed documents into a collation, a chassis section for assembling enclosures (canceled checks in the particular application of the invention being described here) to the collation and stuffing the collation into an envelope, and an output section for further processing of the envelope, such as: sealing, weighing, applying postage, sorting and stacking. The input section of the inserter system 100 includes: a burster module 120, an accumulator module 140, a folder module 160 and a conveyor/staging module 180. The chassis section of the inserter system 100 is only partially shown and includes a first enclosure feeder module 210 and a second enclosure feeder module 220 and other suitable downstream modules for further processing the collation, such as: additional enclosure feeder modules, an envelope feeder module and an insert station module. (For the particular application being described here, one of the enclosure feeders, say the first one, is a check feeder and inserts canceled checks into the collation stream. Others of the enclosure feeders could provide other matched enclosures or could provide generic enclosures.)

The output section of the inserter system 100 is not shown as it has no bearing on the practice of the present invention.

The mechanical construction and arrangement of the various modules that make up the inserter system are well known by those skilled in the art and depends upon the particular requirements of each installation. Since the exact instrumentalities by which each module performs its operations is not necessary for an understanding of the present invention, the discussion of the design details will be will be limited to that which is necessary for an understanding of the present invention. A more detailed description of an inserter system of the type in which the present invention may be employed is provided in U.S. Pat. No. 4,547,856, entitled UNIVERSAL MULTI-STATION DOCUMENT INSERTER, issued Oct. 15, 1985, assigned to the assignee of the present invention and hereby incorporated by reference.

The documents to be processed in the inserter 100 are initially in the form of webs 106 and 108 each containing a plurality of forms (bank statements, all pages of a bank statement for a given customer on one web) joined together at transverse lines of weakening or perforation lines. The webs 106 and 108 are normally stored in stacks 102 and 104, respectively, in a fan-fold configuration. The webs 106 and 108 may contain forms of the same or different sizes.

The webs 106 and 108 are first drawn into the burster module 120 which withdraws the webs 106 and 108 from the fan-fold stacks 102 and 104, respectively. The web 106 is advanced by feed assembly 122*a* past a scanner assembly 125*a* toward a bursting assembly 123*a* that separates the forms making up the web 106 into discrete documents or sheets. The feed assembly 122*a*, scanner assembly 125*a* and the bursting assembly 123*a* are all of well known construction. The feed assembly 122*a* includes a tractor drive having a sprocketed belt for engaging the sprocket holes on the lateral edges of the web 106. As the web 106 is fed to the bursting assembly 123*a*, the scanner assembly 125*a* scans a specialized form called a control document (not shown) for a control code (not shown). The control code is typically a barcode and provides instructions and other information to the inserter system 100 for assembling a mail piece corresponding to the control document. (The control document in case of a bank statement mailing is the first page of the bank statement itself) The bursting assembly 123*a* includes a pair of bursting rollers 124*a*, a bursting cone 126*a* and a pair of feeding rollers 128*a*. As is well known in the art, at the instant that a perforation line in the web 106 that separates two adjacent forms is over the burst cone 126*a*, the bursting rollers 124*a* are momentarily decelerated while the feeding rollers 128*a* continue to feed at a constant rate. This action produces a momentary tension on the web 106 and, with the assistance of the burst cone 126*a*, generates sufficient force to snap or burst the lead form of the web 106 from the upstream adjacent form. The web 108 is handled in analogous fashion by feed assembly 122*b*, scanner assembly 125*b* and bursting assembly 123*b* which includes a pair of bursting rollers 124*b*, a burst cone 126*b* and a pair of feeding rollers 128*b*.

The discrete documents from the webs 106 and 108 are then fed between suitable guides 130*a* and 130*b* that direct them to a single pair of feed rollers 132 and past a movable deflector 134 to the accumulator module 140. The accumulator module 140 includes an upper and lower transport assembly 142*a* and 142*b*, respectively, for stacking a plurality of documents on top of each other. The deflector 134 actuates between two positions so as to direct the documents separated from the webs 106 and 108 to either the upper transport assembly 142*a* or lower transport assembly 142*b*. The upper transport assembly 142*a* includes an adjustable stacking device 144*a* while the lower transport assembly 142*b* includes an adjustable stacking device 144*b*.

In operation, documents from the webs 106 and 108 are feed in alternating fashion between the upper transport assembly 142*a* and the lower transport assembly 142*b*. For example, to assemble a first collation, a first control document from web 106 is scanned and provides the insert system 100 with information about the number of following forms from web 106 that belong with the first control document, in this example three forms. Thus, with the deflector 134 positioned as shown, the first control document and the following three forms are sequentially fed, burst and directed into upper transport assembly 142*a* to assemble the first collation containing four documents (the control document and the following three forms). Next, to assemble a second collation, the web 108, containing a second control document having a barcode thereon, is advanced by the burster assembly 120. Again, the barcode provides the insert system 100 with information of the number of following forms from web 108 that belong with the second control document, in this example two forms. Thus, the deflector 134 must be repositioned so that after the second control document and the following two forms are sequentially fed and burst, they are directed into lower transport assembly 142*b* to assemble the second collation containing three documents (the control document and the following two forms). In this manner, collations are sequentially and alternately assembled in the upper and lower transport assemblies 142*a* and 142*b* so as to increase overall system throughput.

Once a collation has been assembled in the accumulator module 140, it is fed into the folder module 160 which is capable of accepting collations from either of the upper or lower transport assemblies 142*a* and 142*b* from guides 162*a* and 162*b*, respectively. The folder module 160 includes a first pair of folding rollers 164, a first buckle chute 166 having an adjustable end stop 168, a second pair of folding rollers 170 and a second buckle chute 172 having an adjustable end stop 174. The end stops 172 and 174 are repositionable along the length of the buckle chutes 166 and 172, respectively, depending upon the desired fold configuration. The collations are fed into the first buckle chute 166 until the lead edge of the collation abuts the end stop 168. When this happens, a buckle forms in the collation between the lower roller of pair 164 and the upper roller of pair 170. As the collation continues to feed, the buckle continues to form and is forced between the nip of these rollers. These rollers crease the collation and, as a result, the crease now becomes the new leading edge of the partially folded collation. This lead edge is next directed to the second buckle chute 172 until the lead edge abuts an end stop 174 and a new buckle forms next to the nip between the second pair of folding rollers 170. When this happens, another crease is formed as the collation is forced between the nip of these rollers. Thus, the collation is folded twice. However, those skilled in the art will recognized that the setup of the folder module 160 may be reconfigured to achieve different fold configurations by adjusting the position of the end stops 168 and 174. Furthermore, the buckle shoots 166 and 172 may be bypassed altogether by placing diverters in the feed path of the collation.

As the collation exits the second pair of folding rollers 170 of the folding module 160, the collation is fed into the conveyor/staging module 180. The conveyor/staging module 180 includes an upper O-ring transport assembly 182, a lower O-ring transport assembly 184, and a plurality of solenoid actuated stop assemblies 190 and 194. Each stop assembly 190 and 194 is selectively and independently operable to both stop and allow feeding of the collation. To stop feeding the collation, each stop assembly 190 and 194 includes a collation obstructing surface that is positionable in the feed path of the collation to prevent further downstream travel as the O-rings slip past the collation. On the other hand, to allow feeding the collation, the obstructing surface is repositioned out of the feed path so that the O-rings carry the collation downstream.

As the collation is fed from the conveyor/staging module 180, the collation drops onto the feed deck of the chassis section of the inserter system 100. The first enclosure feeder module 210 includes a stack 212 of enclosures loaded into a feed tray 214 and an enclosure feed assembly 216 for delivering the enclosures in seriatim onto the feed deck and into the path of travel. Additionally, the feeder module 210 includes a ramp 218 which will be discussed in more detail below. Similarly, the second enclosure feeder module 210 includes a ramp 228, a stack 222 of enclosures loaded into a feed tray 224 and an enclosure feed assembly 226 for delivering the enclosures in seriatim onto the feed deck and into the path of travel. Thus, the second enclosure feeder module 220 is substantially similar to the first enclosure feeder module 210. However, in matched mail and other applications, the enclosures in stack 212 and stack 222 will not be identically the same. Those skilled in the art will recognize that any number of enclosure feeder modules can be incorporated into the chassis section. Furthermore, some of the enclosure feeder modules may contain matched or specific enclosures while other enclosure feeder modules may contain generic enclosures.

Running the length of the enclosure feeder modules 210 and 220 is a transport assembly 250 including an endless chain 252 having a plurality of pusher fingers 254 attached thereon. The endless chain 252 is located below the feed deck while the pusher fingers 254 rise and fall below the feed deck as the chain 252 advances. The pusher fingers 254 work in cooperation with the ramps 218 and 228 to assemble the collation to the enclosures so as to form a new collation. The enclosure feed assemblies 216 and 226 deliver the appropriate number of enclosures onto the feed deck of the chassis section downstream from the ramps 218 and 228, respectively. As the pusher fingers 254 advance, the collation is fed up and over ramp 218 landing on top of the waiting enclosures that were fed down from enclosure feed assembly 216. Then, this new collation is fed downstream together by the pusher fingers 254 toward the second enclosure feeder module 220 where the above sequence of events are repeated. The pusher fingers 254 fed the collation, containing both folded documents and enclosures from the first enclosure feeder module 210 up and over ramp 228 landing on top of the waiting enclosures that were fed down from enclosure feed assembly 226. Then, this new collation is fed downstream by the pusher fingers 254 for further processing.

After passing through the enclosure feeder modules 210 and 220, the collation will proceed to further downstream modules, such as: more enclosure feeder modules and an insert station module where the final collation is stuffed into an envelope. Then, the envelope is fed into the output section of the inserter system 100. Those skilled in the art will recognized that it is possible to have further downstream modules and various combinations for these modules. However, the exact arrangement of these modules has no bearing on the practice of the present invention.

Figure 2:
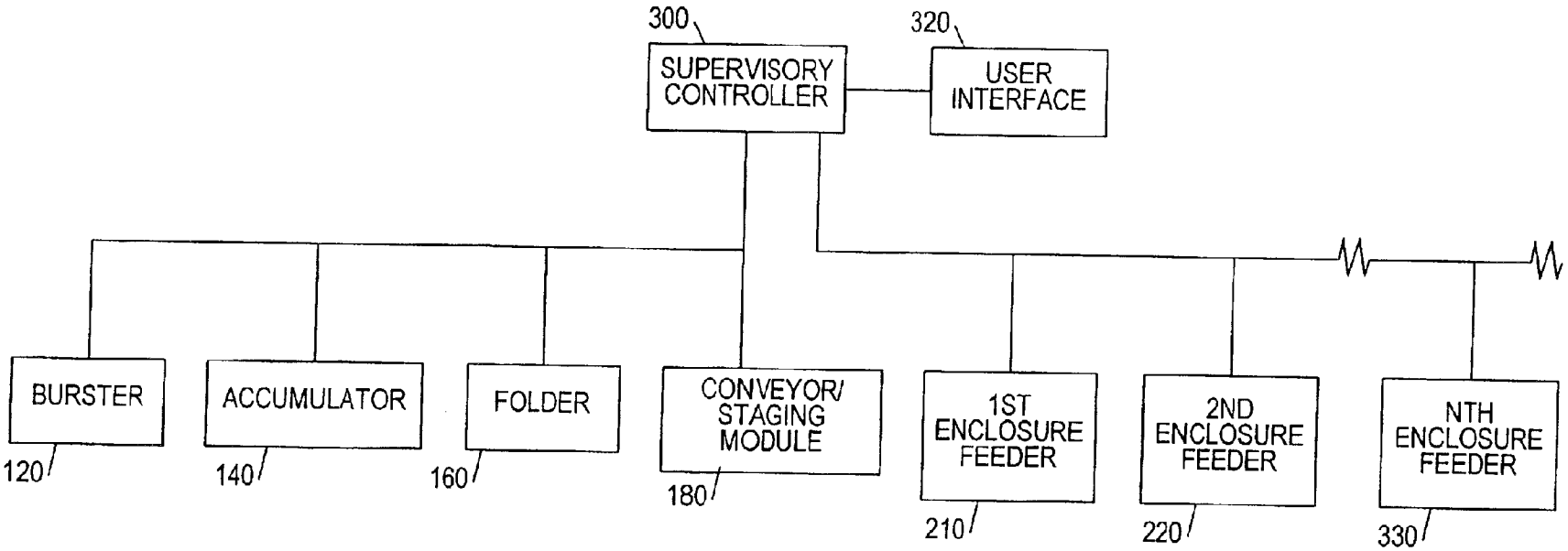
FIG. 2 is a block diagram which represents the communication network of the inserter system of FIG. 1.

From the above description, it should be apparent that the operations of the various modules of the inserter system 100 require a high degree of coordination so as to correctly produce matched mailings. Referring to FIG. 2, a block diagram is shown which represents the communication network of the inserter system 100. A supervisory controller 300 is in communication with a user interface 320, the input section (burster, accumulator, folder, conveyor/staging), and the chassis section (first enclosure feeder 210, second enclosure feeder 220, Nth enclosure feeder 330, etc.) of the inserter system 100. The supervisory controller 300 represents both a high level machine control system that is independent of the exact configuration of the inserter system 100 and a low level machine control system that is dependent on the exact configuration of the inserter system 100. The supervisory controller 300 includes suitably designed memory, microprocessors and software programs to carry out its functions. The supervisory controller 300 commands and coordinates the interactions among the various modules by monitoring the progress of the collations through the inserter system 100 and by providing instructions to the various modules as needed. Additionally, the supervisory controller 300 receives inputs from an operator through the user interface 320. These inputs may be of varying types, but are typically focused on job setup information for the inserter system 100.

The supervisory controller 300 is a hybrid hardware and software system the exact implementation of which is a matter of design choice. A more detailed description of the architecture of the supervisory controller 300 is provided in: U.S. Pat. No. 4,527,790, entitled APPARATUS AND METHOD FOR SEPARATING MULTIPLE WEBS OF DOCUMENTS HAVING THE CAPABILITY FOR ORDERLY SHUT-DOWN AND RE-START OF OPERATION, issued Jul. 9, 1985; and U.S. Pat. No. 4,527,468, entitled APPARATUS FOR SEPARATING MULTIPLE WEBS OF DOCUMENTS INTO DISCRETE DOCUMENTS AND FORMING THE DISCRETE DOCUMENTS INTO PREDETERMINED BATCHES, issued Jul. 9, 1985, both of which are assigned to the assignee of the present invention and hereby incorporated by reference.

Additionally, U.S. patent application Ser. No. 036,134, entitled SYSTEM AND METHOD FOR TWO LEVEL REAL-TIME CONTROL OF AN INSERTING MACHINE issued on Sep. 5, 1995 as U.S. Pat. No. 5,448,490 and U.S. patent application Ser. No. 232,542, entitled OPEN STATION ARCHITECTURE FOR AN INSERTER SYSTEM, issued on Feb. 11, 1997 as U.S. Pat. No. 5,603,059 both of which are assigned to the assignee of the present invention provide further detailed discussion of the supervisory controller 300 and are also hereby incorporated by reference.

Providing a Dynamic Over-count Number

As explained above, according to the prior art, to prevent a check feeder (say, the first enclosure feeder module 210) from continuing to feed an excessive number of checks beyond the expected number (according to the code on the bank statement), a so-called static over-count number is provided as an input to the check feeder and the check-feeder will stop feeding checks if either an account divider page is encountered in the enclosures (canceled checks) it is feeding, or as soon as the number of checks fed exceeds the over-count number. A static over-count number is an over-count number that is the same for all mailpieces/bank statements. An over-count error using a static over-count number can correspond to a situation in which an account divider page is misread or missing and the check feeder continues to feed checks to the collation for a mailpiece, but the checks do not belong to the mailpiece. Instead of using a static over-count number (provided for example by an operator at setup), the invention uses a dynamic over-count number (DON), i.e. one that can vary with each mailpiece, defined for a mailpiece to be the one greater than the expected number of enclosures for the mailpiece.

Figure 3:
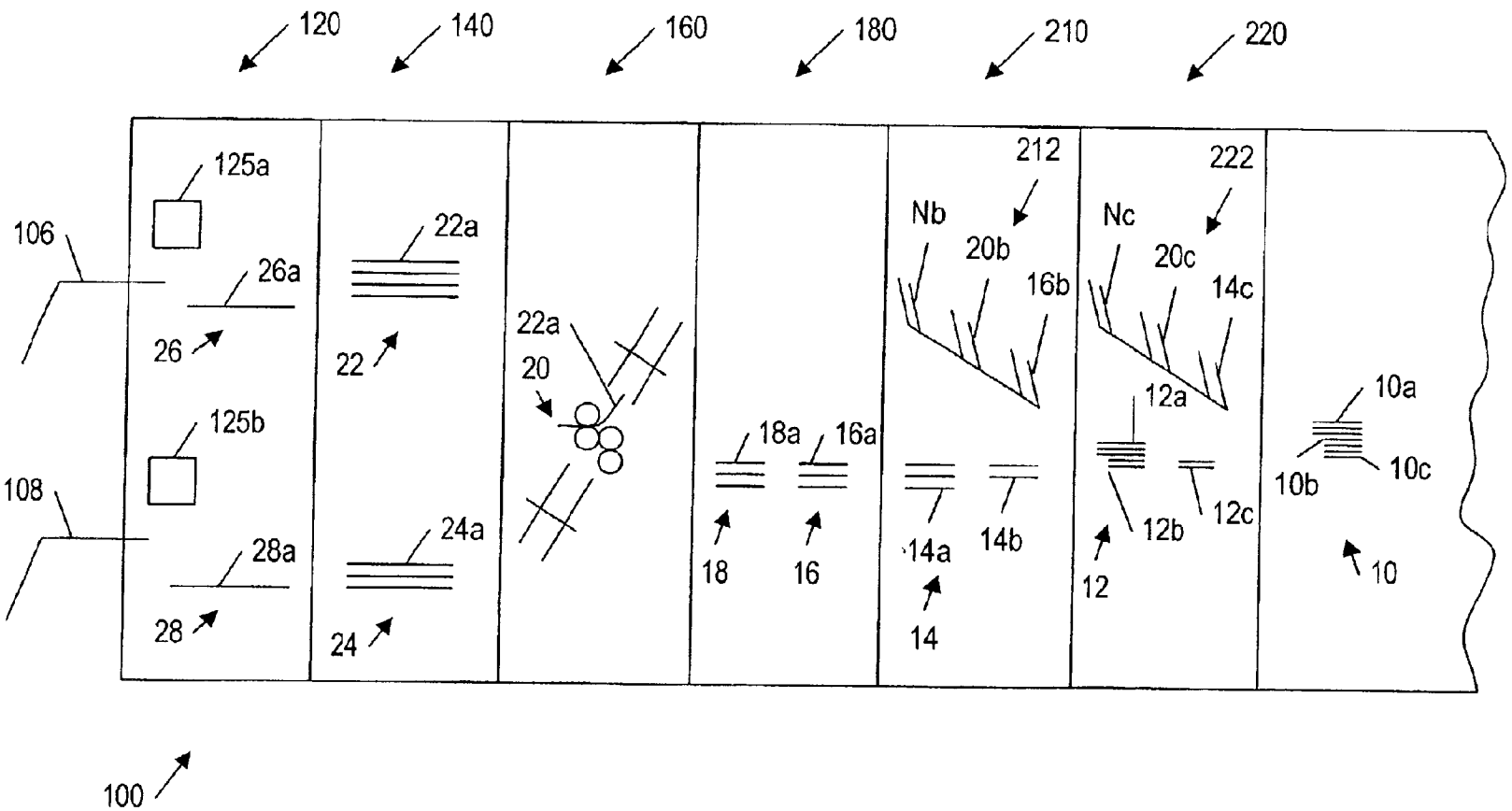
FIG. 3 is a diagrammatic view of the inserter system of FIG. 1 having a plurality of collations in various stages of completion.
Figure 4:
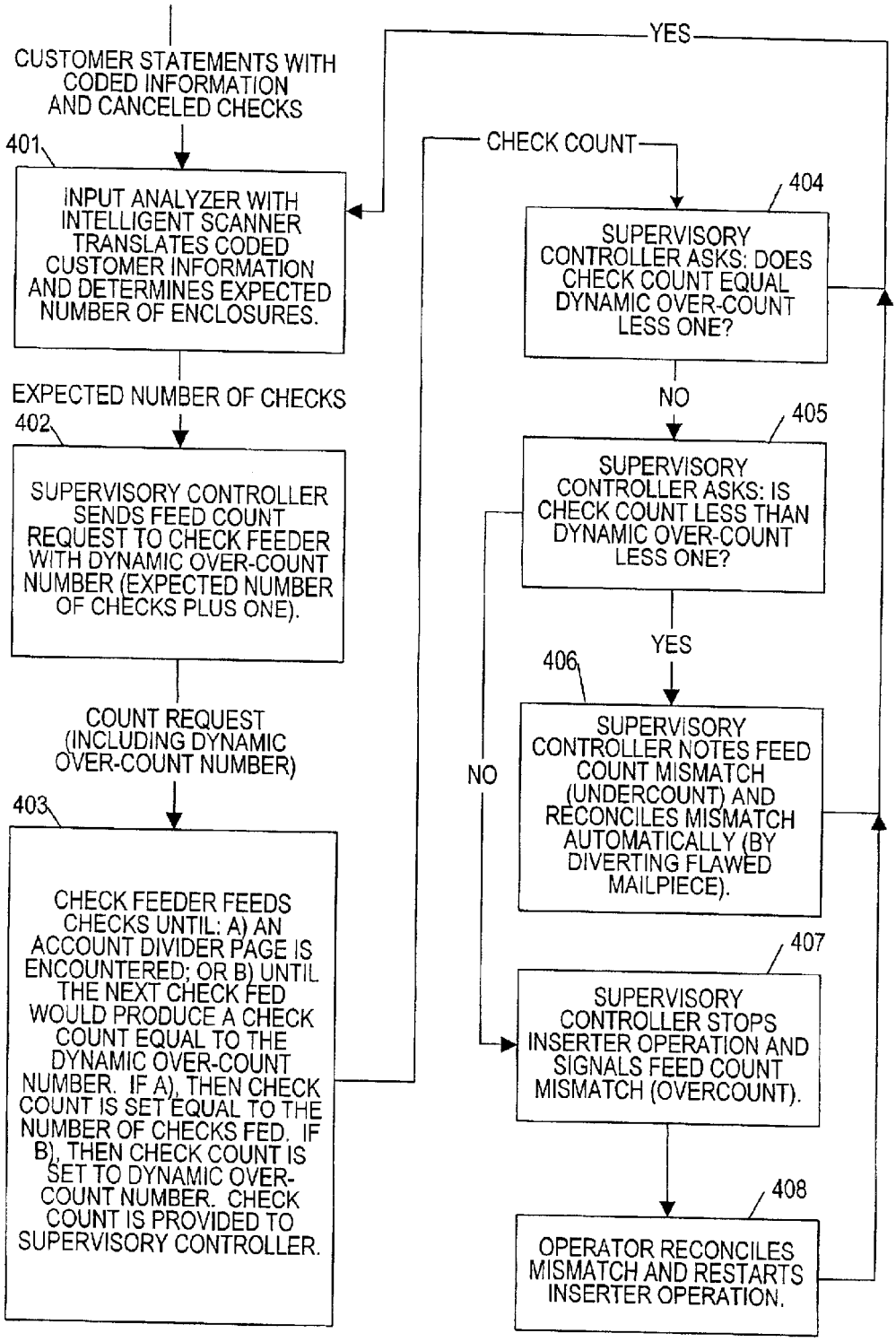
FIG. 4 is a flow chart of a method for dynamically assigning an over-count number, in accordance with the present invention.
Figure 5:
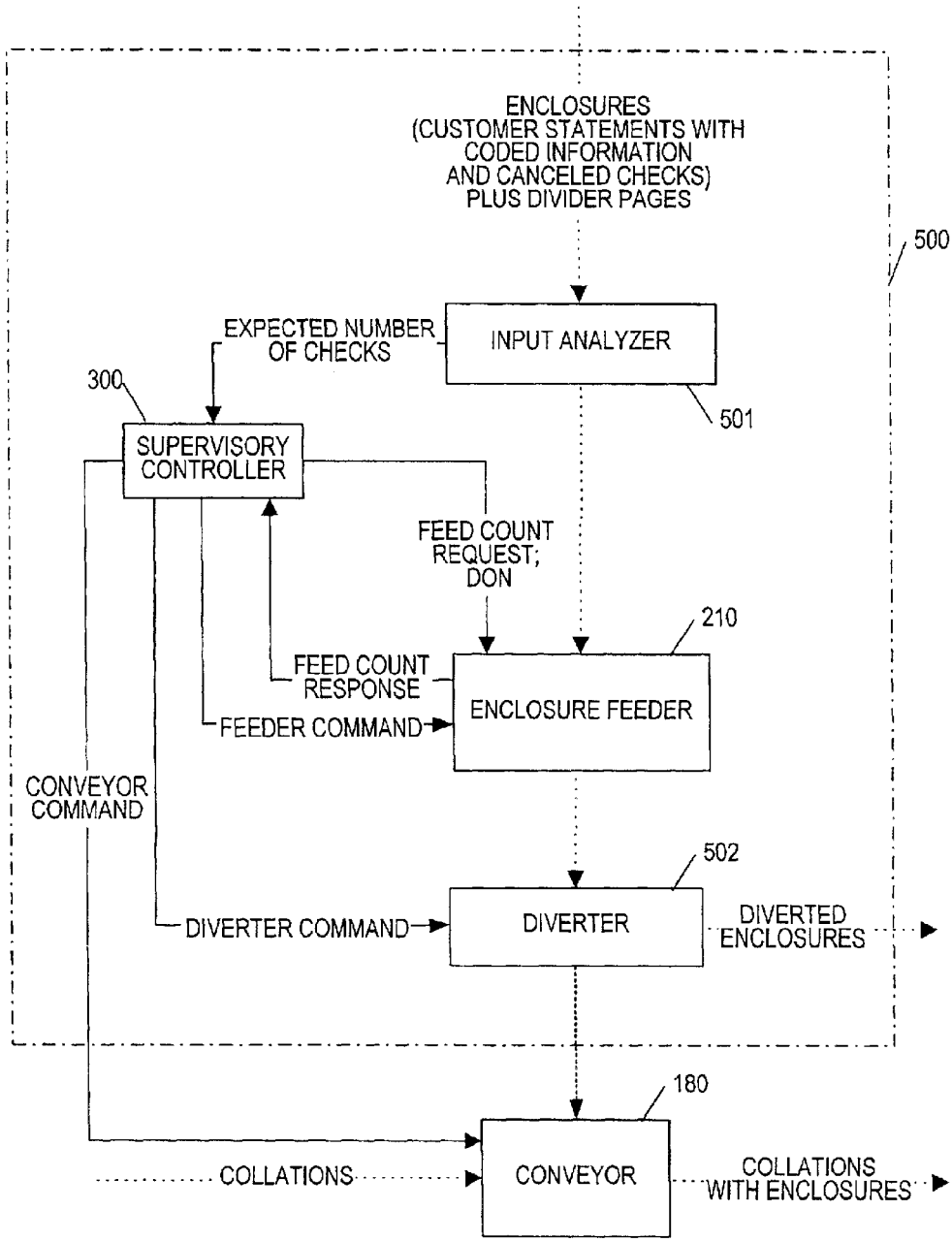
FIG. 5 is a block diagram/flow diagram of an enclosure feeder system according to the invention.

FIGS. 4 and 5 are respectively a flowchart and corresponding block diagram illustrating the operation of an inserter system according to the invention, and more specifically the operation of an enclosure feeder system 500 operative as a component of an inserter system. As shown in FIG. 4, in a first step 401 an input analyzer 501, having an intelligent scanner, translates coded customer information provided on the first page of a bank statement and so determines the expected number of canceled checks that are to be enclosed with the bank statement for the customer, which it then provides to the supervisory controller 300. (In other embodiments, the expected number of enclosures can be provided to the supervisory controller 300 by other means, such as for example by having the expected number provided to the supervisory controller as a separate stream of data input to the supervisory controller from a source other than the input analyzer 501. In such embodiments, the input analyzer 501 may not be needed.) The input analyzer 501 also provides the canceled checks and divider pages to the first enclosure feeder/check feeder 210 (FIGS. 1–3) as enclosures 212 (FIGS. 1 and 3).

In a next step 402, the supervisory controller 300 (FIG. 2) sends a feed count request to the check feeder 210 along with the DON for the next mail piece/bank statement to be processed).

In a next step 403, the check feeder 210 feeds checks until an account divider page is encountered or until the next check, if fed, would produce a check count equal to the DON. The check feeder 210 then provides to the supervisory controller 300 a feed count response (called a check count) that is, ordinarily, the number of checks fed to the supervisory controller 300, but if the check feeder stops before reaching what it recognized as a divider then it uses the DON for the check count/feed count response, which is therefore one greater than the number of checks actually fed (and is also, by definition, one greater than the number expected to be fed).

In the next steps 404 and 405, the supervisory controller 300 compares the check count with the DON. If the check count equals the DON less one, then no error occurred and the inserter system continues normal operation. If the check count equals the DON, then there was an over-count error. If the check count is less than the DON less one, then there was an under-count error, i.e. less checks were provided to the check feeder than were indicated on the bank statement.

In case of an under-count error, in a next step 406, the supervisory controller 300 notes the feed count mismatch (corresponding to an under-count condition) and reconciles the mismatch automatically by commanding a diverter 502 to divert the flawed mailpiece to a location where it can be handled by an operator without disrupting the flow of mailpieces.

In case of an over-count error, in a next step 407, the supervisory controller 300 stops the inserter operation (by stopping the conveyor 180 and the check feeder 210) and signals (to the operator) a feed count mismatch corresponding to an over-count condition. Then in a next step 408, an operator reconciles the mismatch (over-count condition) and restarts the inserter operation.

Thus, according to the invention, assuming that the dynamic over-count number is correct (i.e. that the coded information on the bank statement is correct and is correctly translated by the input mechanism of the inserter), in reconciling an over-count condition, an operator will never have to examine more than a single collation/mailpiece. If an over-count error occurs, the operator would most likely find that either the divider page that should have prevented the over-count was either missing or misread, and the operator would then restart the inserter after either manually indicating a divider or providing either a divider page (in case of a missing divider page) or a substitute divider page (in case of a misread divider page).

Scope of the Invention

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. An enclosure feeder system for use with an inserter system that combines collations with a given number of respective corresponding specific enclosures, the enclosure feeder system for providing the enclosures to be combined with the collations, the enclosures for each successive collation ordinarily being separated by a divider indicator for indicating the end of the sequence of enclosures for a collation, the enclosure feeder system comprising:

enclosure feeding means, responsive to a feed count request for a collation and to an expected number of respective corresponding specific enclosures, for feeding the specific enclosures and for providing an enclosure count corresponding to the number of specific enclosures actually fed; and supervisory control means, programmed to provide the feed count request for a collation and the expected number of respective corresponding specific enclosures, and further responsive to the enclosure count corresponding to the number of specific enclosures actually fed, and further programmed to compare the number of enclosures actually fed for a collation to the expected number of respective corresponding specific enclosures;

wherein the supervisory control means monitors for two events and controls the enclosure feeding means to continue feeding enclosures for the collation until at least one of the events occurs, a first of the two events being encountering a divider indicator, and a second of the two events being the number of enclosures is equal to the expected number of enclosures.

2. An enclosure feeder system as in claim 1, further comprising an input analyzer for providing for each collation in the sequence of collations the expected number of respective corresponding specific enclosures; wherein the input analyzer determines the expected number of respective corresponding specific enclosures, based on information provided in a control document included in each collation.

3. An enclosure feeder system as in claim 1, wherein if the enclosure feeding means discontinues feeding enclosures before encountering and recognizing a divider indicator, then the enclosure feeding means uses as the enclosure count for the collation a number based on the expected number of enclosures, and otherwise uses the number of enclosures actually fed for the collation.

4. An enclosure feeder system as in claim 3, wherein the number based on the expected number of enclosures used as the enclosure count is one more than the expected number or enclosures.

* * * * *